US010173794B2

(12) United States Patent
Breulmann

(10) Patent No.: US 10,173,794 B2
(45) Date of Patent: Jan. 8, 2019

(54) PACKAGING MACHINE AND METHOD

(71) Applicant: HAVER & BOECKER OHG, Oelde (DE)

(72) Inventor: Uwe Breulmann, Munster (DE)

(73) Assignee: HAVER & BOECKER OHG, Oelde (DE)

( * ) Notice: Subject to any disclaimer, the term of this patent is extended or adjusted under 35 U.S.C. 154(b) by 35 days.

(21) Appl. No.: 14/899,011

(22) PCT Filed: Jun. 17, 2014

(86) PCT No.: PCT/EP2014/062731
§ 371 (c)(1),
(2) Date: Dec. 16, 2015

(87) PCT Pub. No.: WO2014/202613
PCT Pub. Date: Dec. 24, 2014

(65) Prior Publication Data

US 2016/0122042 A1 May 5, 2016

(30) Foreign Application Priority Data

Jun. 17, 2013 (DE) ..... 10 2013 010 048

(51) Int. Cl.
*B65B 1/32* (2006.01)
*B65B 1/06* (2006.01)
(Continued)

(52) U.S. Cl.
CPC ..... *B65B 1/32* (2013.01); *B65B 1/06* (2013.01); *B65B 1/28* (2013.01); *B65B 39/007* (2013.01)

(58) Field of Classification Search
CPC .... B65B 1/32; B65B 1/06; B65B 1/28; B65B 39/001–39/007
(Continued)

(56) References Cited

U.S. PATENT DOCUMENTS 2,260,718 A * 10/1941 Merrifield ..... B65B 67/12 177/103
2,888,961 A * 6/1959 Haver ..... B65B 1/18 141/272
(Continued)

FOREIGN PATENT DOCUMENTS

CA 929 143 A1 6/1973
CH 554258 A * 9/1974 ..... B65B 1/28
(Continued)

*Primary Examiner* — Jason K Niesz
*Assistant Examiner* — James Hakomaki
(74) *Attorney, Agent, or Firm* — Pearne & Gordon LLP

(57) ABSTRACT

Packaging machine and method for filling dusting product such as bulk material into open-mouth bags via a filling process. The filling process is controlled by weight via a control device and a weighing device. A batching element conveys product and introduces it through a filling spout into an open-mouth bag appended for the filling process. The filling spout is connected with a collecting tank through a flow connection such that a pressure surge occurring during the filling process is utilized for transferring into the collecting tank the displacing air contained in the open-mouth bag and including the dusting product to receive and settle the displacing air in the collecting tank and to deposit at least part of the dust content of the displacing air in the collecting tank as deposited product.

23 Claims, 3 Drawing Sheets

Figure 1:
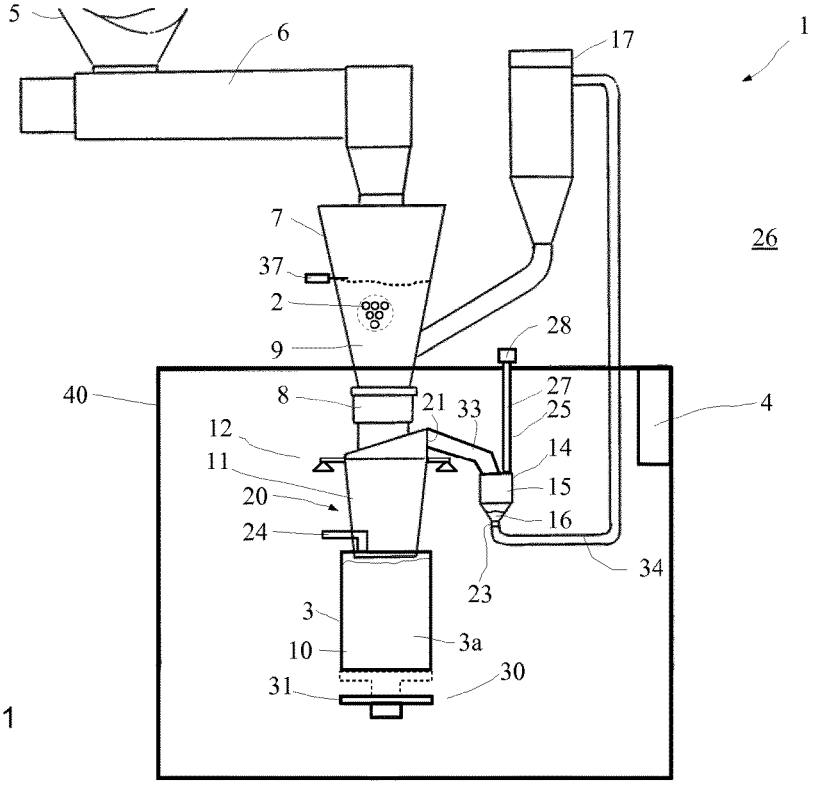

(51) Int. Cl.
*B65B 1/28* (2006.01)
*B65B 39/00* (2006.01)

(58) Field of Classification Search
USPC ..... 53/469, 284.7, 570; 141/10
See application file for complete search history.

(56) References Cited

U.S. PATENT DOCUMENTS 3,285,295 A * 11/1966 Titchenal ..... B65B 1/18 141/10
3,416,620 A * 12/1968 McClusky ..... B65B 39/145 177/123
3,578,041 A * 5/1971 Obara ..... B65B 1/18 141/128
3,707,172 A * 12/1972 Obara ..... B65B 1/16 141/128
4,049,028 A * 9/1977 Harris ..... B65B 39/04 141/10
4,095,625 A * 6/1978 Marpe ..... B65G 69/186 141/286
4,182,386 A * 1/1980 Alack ..... B65G 69/182 141/83
4,418,771 A * 12/1983 Henry ..... G01G 13/024 177/1
4,825,913 A * 5/1989 Stott ..... B65B 39/04 141/114
4,854,353 A * 8/1989 Russell ..... B65B 1/28 141/263
4,872,493 A * 10/1989 Everman ..... B65B 39/04 141/59
5,279,339 A * 1/1994 Derby ..... B65B 1/26 141/59
5,322,096 A 6/1994 Tetenborg et al.
5,380,957 A * 1/1995 Giles ..... G01F 1/80 177/16
5,753,867 A * 5/1998 Konishi ..... G01G 19/393 177/25.18
5,810,060 A * 9/1998 Bolz ..... B65B 31/02 141/287
5,826,633 A * 10/1998 Parks ..... B65B 9/042 141/18
6,268,571 B1 * 7/2001 Benyukhis ..... G01G 19/393 177/25.18
6,373,001 B1 * 4/2002 Kono ..... G01G 15/00 177/25.18
6,662,832 B2 * 12/2003 Baker ..... B65B 39/12 141/10
6,868,876 B2 * 3/2005 Nobbe ..... B65B 1/28 141/286
2003/0006248 A1 1/2003 Gill et al.
2004/0071928 A1 4/2004 Nobbe
2004/0182469 A1 * 9/2004 Concetti ..... B65B 1/02 141/10

FOREIGN PATENT DOCUMENTS

DE 353 088 C 5/1922
DE 356582 C 7/1922
DE 10117770 A1 9/2002
EP 0718194 A1 6/1996
EP 1 368 231 9/2002
WO 02/070347 A1 9/2002
WO 02/090194 A2 11/2002

* cited by examiner

PACKAGING MACHINE AND METHOD

The present invention relates to a packaging machine and a method for filling dusting products such as bulk material into open-mouth bags. Prefabricated, open bags may be delivered to these packaging machines or else the open-mouth bags are manufactured continuously or discontinuously in the packaging machine itself or in a device disposed upstream thereof. Packaging machines in which open-mouth bags are formed from tubular sheets are also called Form-Fill-Seal machines (FFS machines).

Generally, packaging machines for filling bulk material into open-mouth bags take the bulk material intended for bagging from a product supply and pass it through a filling spout into the open-mouth bag appended for filling. During the filling process, air escapes from the filling open-mouth bag wherein dusting product is entrained as well. To avoid contamination of the ambience an aspirator is provided for delivering the aspirated air to a dust collection filter. These dust collection filters tend to consist of deep-bed filters where multiple layers of felt-fabric filters are disposed on top of one another. When the bagged bulk material is changed in these packaging machines then different materials collect in the deep-bed filter so that cloth-cleaning of the dust collection filter does not result in recovering homogeneous material but a mixed product which must be discarded.

To allow recovering at least part of the aspirated bulk material in packaging machines, document EP 1 368 231 B1 discloses a bagging plant for filling powdered bulk material into bags formed of tubular sheets where the air aspirated from the surroundings of the feeding hopper is first conveyed through a suction line and delivered to a separator. The separator comprises a cyclone. The product separated by way of the separator is returned to the product tank. The aspirated air is delivered to the dust collection filter. The load on the dust collection filter is reduced and the material consumption is reduced.

The drawback of this device is that large volumes of ambient air need to be constantly aspirated from the ambience of the feeding hopper. This involves high energy requirement. Moreover the apparatus is highly complex since large volumes of exhaust air need to be processed.

It is therefore the object of the present invention to provide an efficient packaging machine and an efficient method for filling dusting product into open-mouth bags which provides economy of process.

This object is solved by an apparatus having the features of claim 1 and by a method having the features of claim 18. Preferred specific embodiments of the invention are the subjects of the subclaims. Further advantages and features of the present invention can be taken from the general description and the description of the exemplary embodiments.

The packaging machine according to the invention serves to fill dusting products such as bulk material into open-mouth bags by means of at least one filling process. The packaging machine comprises a control device and a weighing device for weight-dependent control of the filling process. A product supply and at least one batching element is provided e.g. for conveying the product. The product is conveyed through a filling spout into the open-mouth bag prepared respectively appended for the filling process. The filling spout is connected with a collecting tank via at least one flow connection which causes that a pressure surge occurring during a filling process is utilized for transferring into the collecting tank at least part of the displacing air that has entered the open-mouth bag and comprises dusting product, to receive in the collecting tank the displacing air forced out of the open-mouth bag in a filling process and containing the dusting product, to settle it and deposit at least part of the dusty portion of the displacing air in the collecting tank as deposited product. The packaging machine according to the invention has many advantages. A considerable advantage of the packaging machine according to the invention is that the complexity of the apparatus can be reduced. Optionally, dedusting is not even required since the air forced out of the open-mouth bag during the filling process flows into a collecting tank where the displacing air can settle so that the dust content or the entrained, dusty product can be deposited in the collecting tank. This provides simple ways and means of recovering the entrained, dusting product without any special apparatus and equipment. The collecting tank can be emptied as required to allow recovering the dusting product.

The displacing air is conveyed, in particular passively and preferably substantially without, and particularly preferably without any further, energy consumption, into the collecting tank where a considerable portion of the dust content in the displacing air settles and is deposited. The displacing air is transported by way of the pressure surge generated in the filling process. Due to the bulk material or product entering the open-mouth bag at high speed, excess pressure builds up in the form of a pressure surge which displaces comparatively rapidly, even flash-like, any air which may already be present in the open-mouth bag, together with the air and a certain dust content entering during filling. Due to the topical excess pressure the escaping displacing air is passively conveyed into the collection chamber where the dust content can settle.

Preferably the collecting tank shows a flow aperture or a channel leading to the surroundings. This allows the displacing air entering the collecting tank from the open-mouth bag to displace any air present therein to the outside. To retain any dust particles the flow aperture toward the surroundings may be provided with a dust collection filter or the like.

In a simple configuration the collecting tank might be at least one pipe extending upwardly. The pipe might be provided with a controllable shutter which in the case of reduced machine power selectively delivers the deposited product either immediately to the open-mouth bag to be filled or else e.g. to the following open-mouth bag to be filled. It is also possible for the collecting tank to extend in a ring in particular entirely or partially around the top portion of the filling spout.

Particularly preferably the collecting tank is connected with a downstream product conveyor for carrying off the product deposited in the collecting tank by means of the downstream product conveyor. The collecting tank is in particular connected with the downstream product conveyor via at least one line. Preferably the collecting tank is disposed between the filling spout and a product conveyor.

In preferred specific embodiments an intermediate container is provided. Preferably the batching element conveys the product from the product supply into the intermediate container. The intermediate container is preferably equipped with a controllable shut-off unit. A filling spout is preferably disposed downstream of the intermediate container.

Opening the shut-off unit allows in particular controlled passing of the product received in the intermediate container to the filling spout.

The or at least one product conveyor is preferably provided to intermittently remove part of the deposited product from the collecting tank and in particular to return it to the intermediate container. The product conveyor can be operated intermittently. It is also possible to only operate the product conveyor selectively or as required. Periodic operation of the product conveyor is preferred. For example the product conveyor can be operated after every filling process or after every two, three, or four filling processes or after another number of filling processes to return to the intermediate container or for example to the product supply the product that accumulated in the collecting tank in the meantime. It is also possible to provide for irregular intervals between operating the product conveyor. It is also possible to operate the product conveyor continuously or indexed during filling.

The product conveyor is in particular provided to deliver to the intermediate container the product that was deposited in the collecting tank.

In preferred specific embodiments the product conveyor and/or the collecting tank is/are provided with at least one sensor which sensor captures a measure of the quantity of the deposited product. This sensor can be any desired type of sensor. It is for example possible to provide the collecting tank with a separate weight sensor or fill level sensor which emits a signal at least if the product deposited reaches or exceeds a predetermined quantity. Or else it is possible to use the weighing device for determining a measure of the quantity of the deposited product. This is possible for example if the weighing device includes the collecting tank in weighing so that after finishing the filling process a new tare weight is determined which allows conclusions about the deposited quantity.

The product conveyor is preferably connected with the intermediate container to deliver the deposited product to the intermediate container.

The collecting tank may in particular be immediately connected with the filling spout so that the flow connection is largely or entirely formed by a passage opening between the filling spout and the collecting tank. At any rate the passage opening is preferably dimensioned large enough so that the pressure surge generated in the filling process causes passage of a sufficient quantity of the displacing air.

The flow connection may comprise, or substantially consist of, a flow duct. A flow duct preferably shows a ratio of a clear, and in particular a maximum clear, diameter of the flow duct to a length of the flow duct of higher than 1:20. This ratio is in particular higher than 1:10 and preferably higher than 1:5. A clear diameter of a flow duct comprising multiple partial ducts is understood to mean a diameter equivalent in terms of flow dynamics. The equivalent diameter in terms of flow dynamics is computed from the sum total of all of the partial ducts, not only from the diameter of one partial duct.

A flow connection formed by a flow duct shows a ratio of a clear cross section of the flow duct to a clear cross section of the filling spout of in particular higher than 1:8 and preferably higher than 1:6 and particularly preferably higher than 1:4. A clear cross section of a flow duct comprising multiple partial ducts is understood to mean a cross section equivalent in terms of flow dynamics. An equivalent cross section in terms of flow dynamics is made up or computed from the sum total of all of the partial ducts, not only from the cross section of one partial duct.

The collecting tank comprises a settling volume. The ratio of a volume of an open-mouth bag to be filled to the settling volume is in particular lower than 20:1 and preferably lower than 10:1 and particularly preferably lower than 5:1. The size of the settling volume of the collecting tank may be provided to be variable.

All the configurations are preferably provided with a dedusting device. The dedusting device is preferably provided for dedusting the region around the filling spout to dedust the ambient air on the outside of the open-mouth bag hanging off the filling spout. This allows to aspirate any dust leaking out to observe the required or desired environmental loads. The filling spout is for example preferably configured telescopic so that leaks may occur in the junctions. At any rate the dedusting device may be configured considerably weaker than provided in the prior art since the air volume to be dedusted is much smaller because the surge pressure can be absorbed in the collecting tank. The invention allows to reduce the deaeration power of the dedusting device, without diminishing cleanliness, in particular to half, one fourth or even to one eighth or less.

In preferred specific embodiments the filling spout has a central product feed and at least one, in particular lateral, air outlet. This configuration allows simple ways and means of using the filling spout both for supplying product and for an outlet of the contained air. The filling spout is connected for one, with the product intended for delivery, and for another, with the collecting tank.

Particularly preferred specific embodiments of the invention provide for the collecting tank to be connected with the ambience through at least one pipe device or a displacement tank. The pipe device that is in particular configured as a pipe or hose extends in particular upright. The pipe can be standing upright or else it can be provided to be inclined to the vertical. The pipe may be configured linear although it may comprise bends and/or turns. The pipe encloses a displacement volume. The displacement volume is in particular at least one tenth and in particular at least one fourth of the volume of the collecting tank, the basic rule being, the larger the better. It is possible for the pipe to show a displacement volume that substantially corresponds to the volume of an open-mouth bag to be filled. The pipe is shut off against the surroundings by means of a suitable shutter, in particular including a filter and preferably a simple filter. Such a filter also prevents foreign bodies, dust or other materials in the surroundings from entering the collecting tank interior. This filter may also be provided as a wire cloth or wire mesh or the like.

A pipe extending upright from the collecting tank offers the advantage of providing a displacement volume. Any air containing dust entering the collecting tank during the filling process forces outside the air present in the displacement volume in the pipe extending upright. This air, however, does not contain any dusty product or at least virtually no dusty product so that the ambience remains largely clean. Any residual dust content is trapped in the indicated filter. In the interval between two filling processes the dusty air present in the pipe that is provided upright and in the collecting tank can settle so that the dust content contained settles downwardly. The upright orientation of the pipe causes the dust content to fall downwardly and/or to glide downwardly on the pipe. The resistance to flow-through of the filter may be reduced by actively letting out the air to avoid pressure buildup and air escaping through the filling system.

In all the configurations it is preferred for the control unit to be in particular set up and configured to control the batching element in dependence on the signals from the weighing device. Depending on the configuration it is possible to control the filling process by the gross weighing method or the net weighing method. Both options allow to control the batching element firstly time-cycled or volumetrically to later switch to weight-control for example in low speed flow.

The weighing device is preferably set up to weigh a filling system. The filling system comprises at least the filling spout so that an appended bag is also weighed to control a filling process by the gross method. This configuration offers considerable advantages since the product filled into the open-mouth bag is directly weighed so as to enable precise weight control. It is possible for the filling system to also comprise the collecting tank so that the collecting tank is also weighed. In this configuration the first filling process causes dust-laden product, which is also weighed, to settle in the collecting tank during the filling process and after terminating the filling process. Thereafter a new tare weight can be determined and used for the second filling process so that the weight accuracy can be considerably improved starting with the second filling process. In the first filling process an empirical value may be used for corrections of the filled quantity.

In preferred configurations the collecting tank is received decoupled from the filling spout. For example a flexible hose or the like may be provided between the collecting tank and the filling spout which causes decoupling of the weight of the collecting tank from the filling spout. Or else a telescopic connection is possible where two telescopic parts are received within one another, guiding the air stream. In this configuration the precise weight is obtained in every filling process by the gross method. Any air displaced from the open-mouth bag and containing the product will not compromise the weight since the product content in the collecting tank is obtained separately without being weighed.

In preferred specific embodiments the control device is set up and configured to control the batching element on a time cycle or by volume control. This allows to firstly collect in the intermediate container a considerable portion of the product intended to be bagged in a filling process. Opening a controlled shut-off unit in the intermediate container allows to empty the content of the intermediate container through the filling spout. While the controlled shut-off unit is closed, product may be conveyed into the intermediate container for example even prior to appending a new open-mouth bag so as to accelerate the entire filling process. For example 80% or 90% of the provided total weight may be collected in the intermediate container so that after opening the controlled shut-off unit just a low speed flow needs to be guided into the open-mouth bag.

It is not necessary to know the precise weight of the product already filled into the intermediate container since conclusions can be made about empirical values of the density.

In all the configurations it is possible and preferred to have the intermediate container permanently connected with the product supply. The intermediate container is preferably only configured to receive part of the quantity to be bagged during a filling process. The product supply can for example show only 80%, 90% or else 50% of the volume that a completely filled open-mouth bag takes up. The intermediate container is in particular not part of the weighed system or the filling system.

Or else it is possible and preferred for the weighing device to be set up to weigh the intermediate container in particular to control filling by the net method. In this configuration the weighed system or the filling system may virtually consist of the intermediate container only. This configuration provides for firstly conveying the entire product quantity intended for bagging into the intermediate container. Subsequently after opening the controlled shut-off unit the content of the intermediate container is emptied through the filling spout into the appended open-mouth bag.

This configuration provides for conveying the entirety of the deposited product or part of the deposited product from the collecting tank into the intermediate container after the filling process ends. The weighing device registers this quantity so that an exact quantity will again be weighed in the subsequent weighing process. The weighing process by the net method can also take into account the product quantity settled in the intermediate container. In a first filling process, empirical values may be used, and the further filling processes may use the preceding weight value or an average value.

In all the configurations it is preferred to provide at least one blowing device for inflating the open-mouth bag as the filling process begins. Although a blowing device first takes air into the open-mouth bag which must be taken back out later, this method offers considerable advantages since for example wrinkles in the bag wall can be avoided. Wrinkles may result in the bag not entirely unfolding if it is of lightweight material, thus the open-mouth bag is filled with less than intended dusting product involving the risk that the open-mouth bag overflows or cannot accommodate the entire product quantity. Inflating the open-mouth bag prior to starting the filling process contributes to avoiding these problems.

In all the configurations it is preferred for the filling spout to be telescopic so that it can be brought to an extended filling position and to a retracted discharge position. A telescopic filling spout allows for example to retract the filling spout for discharging the filled open-mouth bag so that no dust-laden air escapes when discharging the filled bag. Vice versa the filling spout can be extended for appending an open-mouth bag.

A small gap is naturally provided between the telescopic parts of a telescopic filling spout through which dust-laden air can escape outwardly. To prevent or reduce contamination of the environment these configurations preferably provide the filling spout with a dedusting device. This dedusting device can, however, show a capacity that is considerably lower than in conventional systems since dedusting must only be provided for a relatively minor air stream showing low dust loads. The dust content contained may be discarded since the mass fraction is but small. It is also conceivable to provide post-processing of the released air stream. Such post-processing is basically only worthwhile in the case of simultaneous processing for multiple filling spouts.

In all the configurations it is preferred to provide at least one compactor. Such a compactor can act on the open-mouth bag during the filling process and/or after the end of the filling process, compacting the filled product in the bag. It is for example possible to configure a compactor as a bottom vibrator which can be approached to the open-mouth bag from beneath. The bottom vibrator can be temporarily approached to the open-mouth bag from beneath during a filling process to compact the material already filled in. It is also possible to approach the bottom vibrator to the open-mouth bag only after the end of the filling process or during the entire filling process, for example when filling by the net method.

Preferably it is also possible to have a vacuum lance or poker vibrator or the like enter an appended open-mouth bag from above through the filling spout for compacting the product contained therein.

It is also possible to use a lateral vibrator or a lateral rapper which pivots onto the bag from the side.

The method according to the invention serves for filling dusting and in particular readily dusting products such as bulk material into open-mouth bags. For example maltodextrin and other readily dusting edibles or other products can be bagged where product purity is required. Filling takes place by way of a filling process on a packaging machine. The filling process is controlled by weight by means of a control device and a weighing device. At least one batching element controls the dosing and e.g. conveys batches from a product supply. The product is conveyed into the appended open-mouth bag through a filling spout. The pressure surge occurring in a filling process is utilized for transferring displacing air contained in the open-mouth bag and containing dusting product through a flow connection from the filling spout into a collecting tank where it is allowed to settle so that the dust content of the displacing air settles at least partially in the collecting tank as deposited product. The method according to the invention also has many advantages since it provides simple ways and means for efficiently filling and recovering any product deposited. Preferably the deposited product is removed intermittently. The filling process can take place using the gross method or the net method depending on the configuration of the packaging machine. In all the configurations a portion of the quantity to be bagged could first be filled into an intermediate container.

Further advantages and features of the present invention can be taken from the exemplary embodiments which will be discussed below with reference to the enclosed figures.

Figure 2:
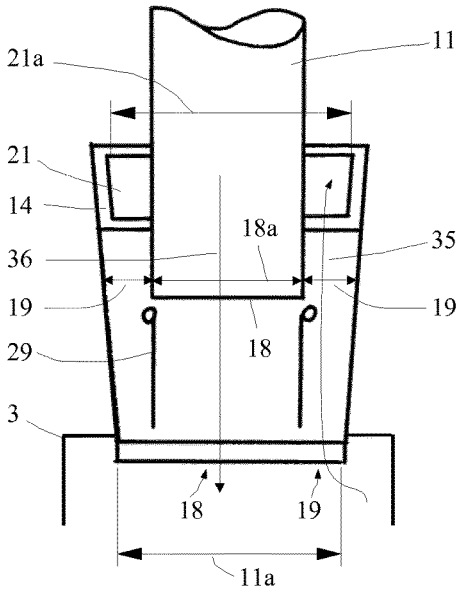
Figure 3:
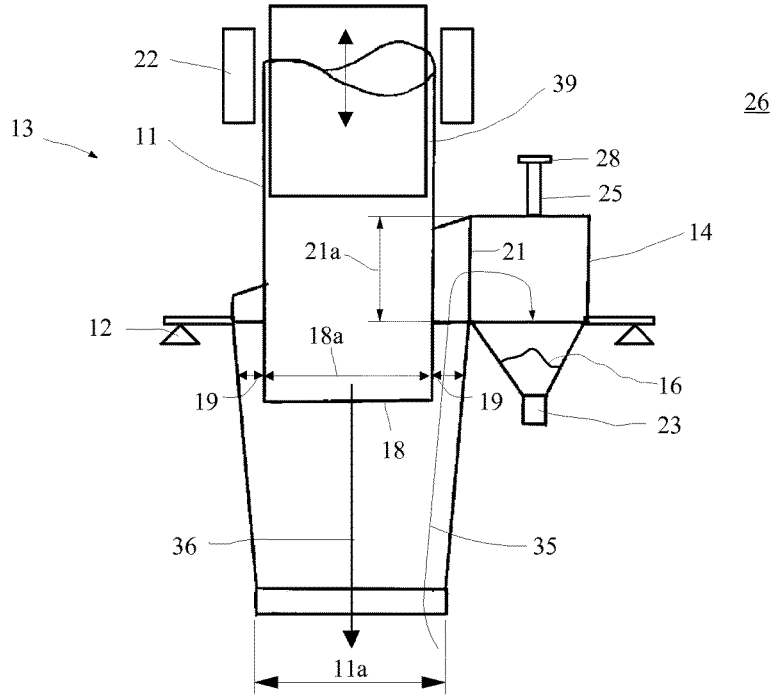
Figure 4:
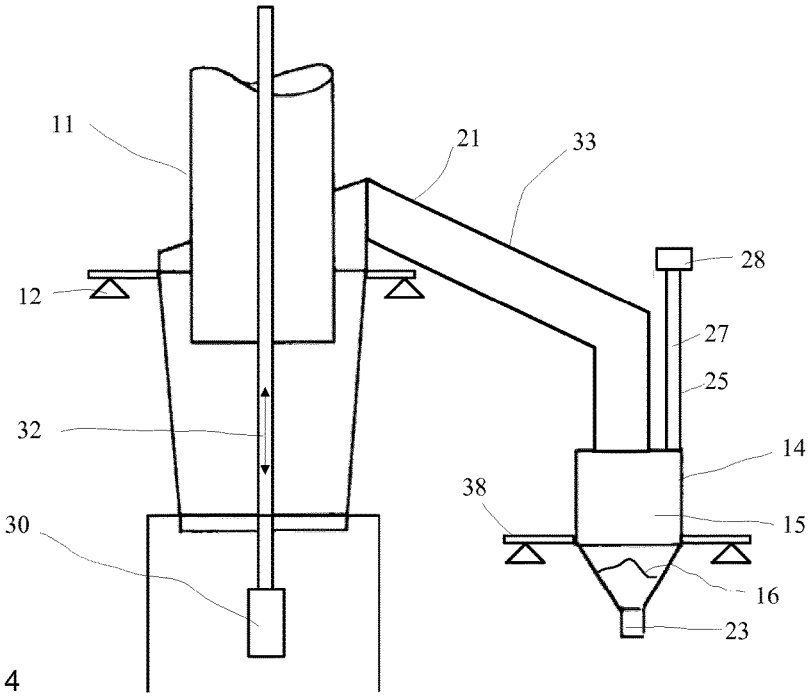
Figure 5:
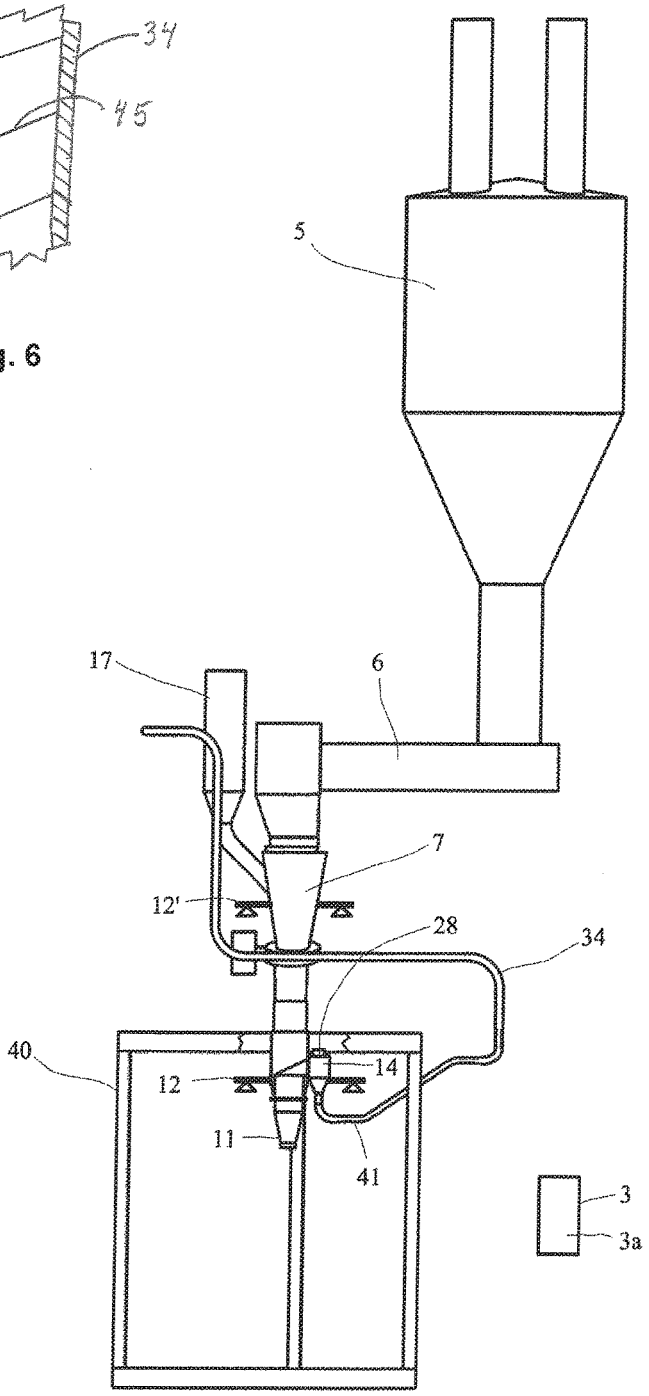

The figures show in:

FIG. 1 a simplistic side view of a packaging machine according to the invention;

FIG. 2 a simplistic cross-section of a filling spout of the packaging machine according to FIG. 1;

FIG. 3 the filling spout according to FIG. 2 rotated 90°;

FIG. 4 a simplistic cross section of another filling spout of a packaging machine according to the invention;

FIG. 5 a total view of the packaging machine according to FIG. 1; and

Figure 6:
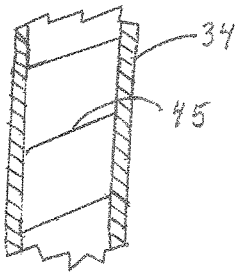

FIG. 6 a schematic longitudinal cross sectional view of a portion of line 34, with the top half of line 34 removed, showing schematically screw 45 therein.

FIG. 1 illustrates a simplistic side view of a packaging machine 1 according to the invention comprising a framework 40. The packaging machine 1 serves to fill dusting product 2 or dusting bulk material into open-top open-mouth bags 3.

Prefabricated open-mouth bags 3 can be delivered to the packaging machine 1. It is also possible and preferred to configure the packaging machine 1 as a so-called FFS system which manufactures open-mouth bags 3 in an incorporated or separate, upstream device from a continuous sheet of tubular film or from a flat sheet of film. Manufacturing the open-mouth bags 3 immediately in the packaging machine 1 offers the advantage of producing the open-mouth bags 3 in an optimal length which can even be adjusted during operation.

An open-mouth bag 3 to be filled is appended from the filling spout 11 of the packaging machine 1 prior to starting the filling process.

A control device 4 serves to control the filling process and to operate the packaging machine 1.

Above the framework 40 of the packaging machine 1 a product supply 5 or silo is provided which stores a large quantity of product 2 intended for filling. This product quantity in the product supply 5 is sufficient for filling a multitude of open-mouth bags 3. Downstream of the product supply 5 there is at least one batching element 6 which conveys product 2 away from the product supply 5, conveying it to the intermediate container 7.

In the presently shown exemplary embodiment two batching elements 6 are provided both of which are configured as screw conveyors. One of the batching elements 6 is used in high speed flow while the other, second batching element 6, which is not visible because it lies behind in the drawing plane, is used for conveying in low speed flow. Dividing of the product stream into high speed flow and low speed flow obtains a better and more precise weight achievement. One screw only is conceivable which operates at different speeds of rotation.

Or else it is possible to use other batching elements. For batching and for transporting the product 2 for example rotary vane locks, conveyor turbines, air conveyors, or other batching elements and batching devices may be used.

Downstream of the batching element 6 or the batching elements 6 the intermediate container 7 is installed which serves to receive a portion 9 of the quantity 10 intended for filling. The volume of the intermediate container 7 or the useful volume of the intermediate container 7 is dimensioned such that it is smaller than the volume of a quantity 10 filled into an open-mouth bag 3. For example the high speed flow portion is conveyed into the intermediate container.

The intermediate container 7 shows at its lower end a shut-off unit 8 which can be controlled by the control device 4. For example a flap shutter may be used. Or else it is possible to use a shut-off blind, a squeeze valve or another shut-off unit.

Downstream of the intermediate container 7 the filling spout 11 is installed which is presently telescopic to allow lowering to the filling position and raising to the discharge position.

The filling spout 11 is part of the weighed system or the filling system 13 so that the open-mouth bag 3 appended from the filling spout 11 is weighed along in a weighing process by means of the weighing device 12. This enables a filling process by the gross method where the weight of product 2 in the open-mouth bag 3 filled thus far remains as the measurement result after deducting the known weights of the filling spout and the other components of the filling system. This allows a precise control of the filled weight.

FIG. 1 illustrates the filling spout 11 in the filling position 20 in which the filling spout 11 enters the opened open-mouth bag 3 from above.

Before the filling process starts the blowing device 24 blows air from above into the open-mouth bag 3 to inflate the bag completely and substantially wrinkle-free. This provides the maximum volume for the product 2 to be filled.

The filling spout 11 passes the product 2 delivered from above, downwardly into the open-mouth bag 3. Moreover the filling spout 11 shows, other than the central product feed, lateral air outlets 19 through which the air forced out of the open-mouth bag 3 during the filling process, or the displacing air, is evacuated through the flow connection 21 into the settling volume 15 and the displacement volume 27. The collecting tank 14 is positioned so that its weight is decoupled from the filling spout 11 by way of a flexible hose which is the flow duct 33.

The flow connection 21 with the flow duct 33 is dimensioned such that the displacing air out of the bag 3 is passively and automatically transferred into the collecting tank 14 due to the pressure surge occurring in the filling process. This means that the flow resistance is low enough to ensure passive passing on and transferring the displacing air into the collecting tank 14. The dimensions of the flow connection 21 are selected such that the flow resistance is passively overcome due to the pressure surge occurring when filling the product into the open-mouth bag. Active conveyance is not necessary. This allows to save considerable energy.

The cross section of the flow duct 33 is preferably larger than ¼ and in particular larger than half the cross section of the filling spout 11. The cross section of the flow duct 33 is particularly preferably about the same size as a cross section of the filling spout, and it may be larger. Preferably a width 21*a* of the flow connection is about the same as a width 11*a* of the filling spout. The width 21*a* is preferably larger than ¼ of the width 11*a* of the filling spout.

The width 21*a* of the flow connection is in particular between approximately ½ of the width of the central product feed 18*a* or the width 11*a* of the filling spout and twice the width of the central product feed 18*a* or the width 11*a* of the filling spout.

The flow duct 33 is preferably configured the shortest possible to minimize flow losses.

The indicated dimensioning ensures a reliable and passive conveyance of the displacing air into the collecting tank. This allows to recover and reuse a major, homogeneous portion of the bulk material entrained in displacement. Moreover the energy requirement for dedusting is reduced.

The flow duct 33 preferably shows a steep downwardly slant from the separating opening in the direction of the collecting tank 14 to reduce any accumulation of product in the flow duct or to evacuate it into the collecting tank 14.

In a packaging machine 1 provided for filling by the net method the intermediate container 7 is weighed separately. Then a rigid pipe or else a flexible hose can be employed as a flow duct 33 for the flow connection 21 since a decoupling of the weight is no longer required in this place.

The size of the collecting tank 14 is shown schematically only, including a settling volume 15 for the air volume forced out of the open-mouth bag 3 to be filled.

When bagging dusting product 2, a considerable portion of dust can also enter the collecting tank 14 with the air forced out of the open-mouth bag 3. The displaced air settles in said tank so that the product contained in the air can settle in the collecting tank 14.

It is possible for the collecting tank 14 to comprise at its lower end a controlled shutter 23 which can be opened as required automatically or else manually. Or else it is possible for the collecting tank 14 to be open at the bottom so that the collecting tank 14 opens into the line 34 without any further shutter.

The deposited product collects at the lower end of the collecting tank 14. The deposited product 16 can be evacuated from the collecting tank 14 as required or at regular intervals. A product conveyor 17 serves to evacuate the deposited product 16. The product conveyor 17 can basically be configured as desired. It is for example possible to dispose in the line 34 a screw that may be flexible for conveying the deposited product 16 through the line 34, presently upwardly, and finally back into the intermediate container 7. Or else any other type of product conveyor is conceivable. The product conveyor 17 is not operated continuously but preferably at periodic or irregular intervals. For example a sensor may be provided in or on the collecting tank 14 to capture a measure of the quantity of the deposited product and as a predetermined value is exceeded, to send a signal to the control device 4 so that the control device 4 causes a part or the entirety of the deposited product 16 to be removed.

The collecting tank 14 is in connection with the ambience 26 through a pipe 25. A displacement volume 27 is present within the pipe 25. The displacement volume 27 is forced out of the pipe 25 to the outward ambience as the air forced out of the open-mouth bag 3 enters the collecting tank 14. Since the air in the displacement volume 27 has time to settle, the dusting product is deposited and accumulates on the bottom of the collecting tank 14.

The settling volume 15 and/or the displacement volume 27 may be configured for varying sizes in dependence on the bag volumes to be filled and/or of the suspension characteristics of the dusting product.

A filter 28 may be provided on the end of the pipe 25 to prevent any foreign matter from entering from the outside and optionally to prevent any dust content still present in the displacing air from escaping outwardly.

The intermediate container 7 may be provided with a sensor 37 for the filling level of the product 2 already filled. This allows volume-controlled pre-filling of the intermediate container 7 for high speed flow.

Since product is firstly conveyed from the product supply 5 into the intermediate container 7 and only thereafter into the open-mouth bag, the heights of product fall are comparatively low so that only a small quantity of air can enter the product 2. This causes an accelerated filling process.

The compactor 30 which in this case is a bottom vibrator 31, may be approached to the bag bottom from beneath at periodic intervals during the filling process or after the end of the filling process for compacting the product 2 which is present in the open-mouth bag 3.

FIG. 2 shows a schematic cross section of the filling spout which is employed for example in the packaging machine 1 according to FIG. 1. The filling spout 11 schematically shows an appended open-mouth bag 3. The product stream 36 is introduced into the open-mouth bag 3 downwardly from above. The product stream 36 is introduced in a central portion respectively along the central product feed 18. Lateral regions are presently provided with lateral air outlets 19 through which the air forced upwardly out of the open-mouth bag is evacuated.

In all the cases an open-mouth bag is tightly received by its open top end on the filling spout 11 to avoid the escape of dust-laden air to the outside.

The evacuated, dust containing air is guided in the lateral air outlets 19 and introduced into the collecting tank 14. Air 35 exiting the open-mouth bag 3 is shown by an arrow.

The bottom end of the filling spout 11 shows flap shutters 29 which allow to close the filling spout 11 at least spill-proof to ensure bag changes after the end of the filling process without contaminating the packaging machine by spilled matter.

FIG. 2 shows the dimensions 11*a*, 18*a* and 21*a* relative to one another in this preferred embodiment. The width 21*a* of the flow connection is somewhat larger than the width 11*a* of the filling spout which in turn is larger than the width 18*a*. The generous dimensions and cross sections achieve an efficient, passive conveyance of the displacing air.

FIG. 3 shows another exemplary embodiment of a cross section of the filling spout 11 for the packaging machine 1 according to FIG. 1.

The filling spout 11 is permanently connected with the collecting tank 14 so that other than the filling spout 11 the collecting tank 14 is also part of the filling system 13 or the weighed system. This means that any product 16 which settles on the collecting tank 14 during the filling process is included in weighing when applying the gross weighing method. This settling product quantity 16 may basically result in a systematic measuring error or weight error of the filled open-mouth bags unless it is taken into account. Therefore an empirical value for the expected settled product quantity 16 is applied in a first filling process and the following filling processes use the measurement values resulting after discharging a filled open-mouth bag 3. The deposited product 16 can be determined and in the following filling process a corresponding surplus quantity is filled into the open-mouth bag 3 after zero taring.

FIG. 3 shows the telescopic filling spout 11. A (simplistic) gap 39 can be recognized between the telescopic parts of the filling spout. A dedusting device 22 is provided to not let any escaping dust be released into the ambience. A relatively small amount of air is aspirated in dedusting so that the dedusting device can be considerably smaller than in the prior art.

The dust-laden air forced out of the open-mouth bag 3 during filling is introduced into the collecting tank 14 through the lateral air outlets 19 along the air flow 35 through the flow connection 21. The collecting tank 14 is connected with the ambience 26 via a pipe 25 and a filter 28 at the end of the pipe 25.

The width 21*a* of the flow connection preferably corresponds to the contact surface between the filling spout 11 and the collecting tank 14. The filling spout 11 shows a width 11*a* that is larger than the width 18*a* which in turn is larger than the width 21*a* of the flow connection. The width 21*a* of the flow connection is larger than ¼ or even ½ of the width of the filling spout 11*a*. The same applies to the flow cross-sections so that the flow cross-section of the flow connection is larger than ⅓ and preferably larger than ⅓ or ½ of the flow cross-section of the filling spout 11.

The collecting tank 14 contains a settling volume 15. The introduced air settles and the contained product accumulates on the bottom of the collecting tank 14 as deposited product 16. The deposited product 16 can be removed through a connected line. A controlled shutter 23 is provided on the bottom of the collecting tank 14 as required.

FIG. 4 shows another configuration of a filling spout 11 for a packaging machine according to FIG. 1. In this case the filling spout and an appended bag 3 are weighed together by the gross method. While a weighing device 12 weighs the filling spout 11, the collecting tank 14 is also provided with a weighing device in the form of a sensor 38. The weight sensor 38 captures the weight of the collecting tank 14 so that the quantity of the deposited product 16 can be captured. To decouple the weight of the collecting tank 14 from that of the filling spout 11, a flexible hose is provided as a flow duct 33 between the filling spout 11 and the collecting tank 14. The flexible hose may extend over the entire length or only part thereof. The indicated relationships of the dimensions and flow cross-sections apply again.

The collecting tank 14 in turn may be provided with a pipe 25 having a displacement volume 27. The end in turn is provided with a filter 28. A collecting tank 14 having sufficiently large dimensions may allow to dispense with the pipe 25.

Additionally shown is a vacuum lance 32 as the compactor 30 which can enter the open-mouth bag 3 from above during the filling process or after the end of the filling process for deaerating the interior of the open-mouth bag 3.

FIG. 5 shows an approximately true to scale side view of an embodiment of a packaging machine 1 according to the invention where a product supply 5 is provided above the framework 40 which is followed by a batching element 6 downstream. The batching element 6 conveys the product into an intermediate container 7 from which the product 2 is conveyed further through the filling spout 11 into an appended bag 3.

A collecting tank 14 serves for settling the air which is forced out of the bag 3 during the filling process and which passes through the flow connection 21 into the collecting tank 14. The contained product is deposited in the collecting tank 14 on the bottom of the collecting tank.

The volume of the collecting tank 14 including the volume of the flow duct and the displacement volume is preferably larger than 1/10 and in particular larger than ⅙ or ¼ of the volume 3*a* of the open-mouth bag 3. The ratio may be 1:2 or larger. The volume may in particular be larger than the volume 3*a* of the open-mouth bag.

The product conveyor 17 conveys the deposited product 16 as required through a line 34 formed by a flexible hose 41 and returns it to the collecting tank 7.

It is possible to weigh the intermediate container 7 separately by a weighing device 12' so as to enable filling by the net method. In the filling process the exact weight of the intended fill quantity 10 is firstly collected in the intermediate container 7 and thereafter introduced into the open-mouth bag 3.

It is also possible to provide only part of the intended fill quantity 10 for in-process storage in the intermediate container 7 and to weigh the filling spout 11 by means of a weighing device 12 so as to employ the gross method for bagging.

In all the configurations applying the gross method it is also possible to dispense with an intermediate container 7. Then an open bag 3 is for example immediately filled by the batching element 6.

On the whole the invention has considerable advantages. The fact that the air forced out of the open-mouth bag 3 during filling is guided into a collecting tank 14 comprising a settling volume 15 and preferably being in connection with the ambience 26 through a pipe 25 having a displacement volume 27, allows to recover a substantial, homogeneous proportion of the product contained in the released air. The collecting tank 14 provides sufficient time so that the dust content in the air settles and can be removed as deposited product 16. Depending on the size of the collecting tank 14 and on its capacity for deposited product 16 the deposited product 16 can be emptied or removed after each filling process or at specific intervals or the like. Product return is preferred after each filling process if a homogeneous grain-size distribution in the bags is decisive.

The invention dispenses with a large dedusting construction which would have to process the entire air forced out of the open-mouth bag 3. Optionally a dedusting system of considerably smaller capacity may be employed for example for dedusting the gap of a telescopic filling spout. As a rule, however, this requires less than half or even less than one fourth of the dedusting capacity of conventional packaging machines.

The product 16 deposited in the collecting tank is homogeneous and can be reused, and in this case it is bagged again in the following filling process. This means that even a change of products involves relatively minor cleaning actions.

List of reference numerals:

| | |
|---|---|
| 1 | packaging machine |
| 2 | product, bulk material |

-continued

| List of reference numerals: | |
|---|---|
| 3 | open-mouth bag |
| 3a | volume |
| 4 | control device |
| 5 | product supply, silo |
| 6 | batching element |
| 7 | intermediate container |
| 8 | closing unit |
| 9 | portion of product quantity |
| 10 | filled quantity |
| 11 | filling spout |
| 11a | width |
| 12 | weighing device |
| 13 | filling system |
| 14 | collecting tank |
| 15 | settling volume |
| 16 | deposited product |
| 17 | product conveyor |
| 18 | central product feed |
| 18a | width |
| 19 | lateral air outlet |
| 20 | filling position |
| 21 | flow connection |
| 21a | width |
| 22 | dedusting device |
| 23 | shutter |
| 24 | blowing device |
| 25 | pipe |
| 26 | ambience |
| 27 | displacing volume |
| 28 | filter |
| 29 | flap shutter |
| 30 | compactor |
| 31 | bottom vibrator |
| 32 | vacuum lance |
| 33 | flow duct |
| 34 | line |
| 35 | air flow |
| 36 | product stream |
| 37 | sensor |
| 38 | sensor |
| 39 | gap |
| 40 | framework |
| 41 | flexible hose |

The invention claimed is:

1. Packaging machine for filling dusting product into open-mouth bags by way of a filling process, having a control device and a weighing device for weight-dependent control of the filling process, and having a product supply and at least one batching element and with a filling spout through which the product can be delivered to a prepared open-mouth bag during the filling process, wherein the filling spout is connected with a collecting tank through a flow connection such that dusting product flowing towards and into the open-mouth bag during the filling process causes a pressure surge which passively conveys (a) displaced air from the open-mouth bag and (b) dust from the dusting product through the flow connection and into the collecting tank, where at least part of the dust settles out of the displaced air and settles in the collecting tank as deposited product.

2. The packaging machine according to claim 1, wherein the collecting tank is connected with a downstream product conveyor for removing the deposited product by means of the downstream product conveyor.

3. The packaging machine according to claim 2 wherein the downstream product conveyor is provided to intermittently remove at least part of the deposited product.

4. The packaging machine according to claim 2 wherein an intermediate container equipped with a controlled shut-off unit is provided to which the batching element can deliver product from the product supply and wherein the downstream product conveyor is connected with the intermediate container for returning the deposited product to the intermediate container.

5. The packaging machine according to claim 1 wherein the collecting tank is immediately connected with the filling spout so that the flow connection is at least in part formed by a passage opening between the filling spout and the collecting tank.

6. The packaging machine according to claim 1 wherein the flow connection is formed by a flow duct wherein the ratio of a clear diameter of the flow duct to the length of the flow duct is higher than 1:10.

7. The packaging machine according to claim 1 wherein the flow connection is formed by a flow duct wherein the ratio of a cross section of the flow duct to a clear cross section of the filling spout is higher than 1:4.

8. The packaging machine according to claim 1 wherein the size of a settling volume of the collecting tank is variable.

9. The packaging machine according to claim 1 wherein the collecting tank is connected with the ambience through a pipe extending upright.

10. The packaging machine according to claim 9 wherein a displacement volume of the pipe is variable.

11. The packaging machine according to claim 1 wherein the weighing device is set up to weigh a filling system wherein the filling system comprises at least the filling spout so that an appended open-mouth bag is also weighed for performing a filling process by the gross method.

12. The packaging machine according to claim 11 wherein the filling system also comprises the collecting tank.

13. The packaging machine according to claim 11 wherein the collecting tank is accommodated decoupled from the filling system.

14. The packaging machine according to claim 1 wherein the control device is set up and configured to operate the batching element on a time cycle or by volume control so as to collect in an intermediate container a considerable portion of the product intended for bagging during a filling process and to empty it through the filling spout into the open-mouth bag by opening a controlled shut-off unit.

15. The packaging machine according to claim 1 wherein the weighing device is set up to weigh an intermediate container for performing a filling process by the net method.

16. The packaging machine according to claim 1 wherein at least one compactor is provided for compacting filled product in the open-mouth bag.

17. The packaging machine according to claim 1 wherein the filling spout comprises a central product feeder and at least one lateral air outlet.

18. Method for filling dusting product into an open-mouth bag by way of a filling process on a packaging machine wherein weight-dependent control of the filling process is provided by means of a control device and a weighing device wherein at least one batching element controls the dosing of dusting product from a product supply and fills it through a filling spout into the open-mouth bag that is prepared for the filling process, wherein the dusting product flowing towards and into the open-mouth bag during the filling process causes a pressure surge which passively conveys (a) displaced air from the open-mouth bag and (b) dust from the dusting product through a flow connection and into a collecting tank connected with the filling spout so that dust content of the displaced air settles at least partially in the collecting tank as deposited product.

19. The method according to claim 18 wherein the deposited product is intermittently removed from the collecting tank.

20. The method according to claim 18 wherein the filling process is performed by either of gross or net methods.

21. The method according to claim 18 wherein a portion of the quantity of dusting product to be bagged is firstly filled into an intermediate container.

22. The packaging machine of claim 2, wherein the downstream product conveyor can evacuate deposited product from the collecting tank by a screw disposed in a line.

23. The method according to claim 18, wherein a downstream product conveyor evacuates deposited product from the collecting tank by a screw disposed in a line.

* * * * *